US006585111B1

(12) United States Patent
Shervington et al.

(10) Patent No.: US 6,585,111 B1
(45) Date of Patent: Jul. 1, 2003

(54) METAL FOAM CONTAINER

(75) Inventors: Evelyn Arthur Shervington, East Harting Petersfield (GB); Michael Ernest Garrett, Woking (GB); Silvia Beatriz Dougill, London (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/625,894

(22) Filed: Jul. 26, 2000

(30) Foreign Application Priority Data

Jul. 27, 1999 (GB) ..... 9917616

(51) Int. Cl.[7] ..... B65D 81/00
(52) U.S. Cl. ..... 206/0.7
(58) Field of Search ..... 96/121, 122, 131; 137/563, 571; 206/0.7, 0.6; 428/34.1

(56) References Cited

U.S. PATENT DOCUMENTS 4,842,909 A * 6/1989 Brassell ..... 428/34.1
5,518,528 A * 5/1996 Tom et al. ..... 95/103
5,731,260 A * 3/1998 Abell ..... 502/416
5,876,488 A * 3/1999 Birbara et al. ..... 96/111
6,015,041 A * 1/2000 Heung ..... 206/0.7
6,074,972 A * 6/2000 Bratton et al. ..... 502/4

FOREIGN PATENT DOCUMENTS

| | | |
|---|---|---|
| DE | 41 12 358 A1 | 10/1992 |
| DE | 197 04 968 A1 | 7/1998 |
| EP | 0 892 208 A1 | 1/1999 |
| WO | WO 96/24435 | 8/1996 |
| WO | WO 97/36819 | 10/1997 |

* cited by examiner

*Primary Examiner*—Jim Foster
(74) *Attorney, Agent, or Firm*—Philip H. Von Neida; Salvatore P. Pace

(57) ABSTRACT

A gas container is made from metal foam and the spaces defined by the open-celled structure are filled with a solid adsorbent material such as a zeolite or an activated carbon. The container may be made in the form of a panel.

1 Claim, 1 Drawing Sheet

METAL FOAM CONTAINER

BACKGROUND OF THE INVENTION

The present invention relates to metallic foam structures and more particularly to metallic foam structures used as high pressure gas containers.

Foam structures are known in industry and the number of applications for metallic foam structures is continually increasing. For example, aluminium foam metal having a continuously connected, open celled (reticulated) geometry is available and employed in:

(a) Energy/impact adsorbers;

(b) Heat exchangers; and (c) Lightweight composite panels.

In the gas distribution industry, the gas containers are invariably cylindrical in shape with thick walls and convex or concave ends. These known containers are simple, robust and contain maximum quantities of gas for any given weight or dimension. However, their main disadvantages are the inflexibility of their shape and weight limitations.

Foam structures have now been proposed for high pressure gas containers and, in particular, high pressure gas containers having irregular shapes, for example a non-cylindrical or spherical shape. When irregular or complex shapes are required, then foam material such as metal foams are formed typically by mixing small quantities of a gasifier e.g. titanium hydride with aluminium powder and subjecting the mixture to heat and pressure to form a sintered sheet.

The sintered sheet or a portion thereof is then placed in a mould which is then heated to higher temperatures at which the metal melts and hydrogen is released from the titanium hydride to form an even dispersion of bubbles. The bubbles are then fractured so that when placed in a thin containment material or when the outside surface is sealed in some way, for example by melting the outer aluminium layer or by casting in resin, the foam acts as a strengthening material.

It is an aim of the present invention to provide a gas container made from metal foam but in which the open-celled structure is filled with a solid gas adsorber material.

SUMMARY OF THE INVENTION

According to the present invention, there is provided a gas container made from metal foam with the spaces defined by the open-celled structure substantially filled with a solid gas adsorber material.

The solid gas adsorber material may be a zeolite, an activated carbon or a silicate and the gas container may be of any shape desired, for example the shape of a panel.

A plurality of panel-shaped gas containers may be arranged in series and connected together by connectors comprising at least one small-bore tube embedded in a foamed rubber matrix which is encompassed by a protective metallic sheath.

In one embodiment, the gas container may be made by delivering the solid gas adsorber and mixing it with molten aluminium at a temperature just before the molten aluminium goes solid. Alternatively, the molten aluminium may be poured over a matrix of particles to form a block.

BRIEF DESCRIPTION OF THE DRAWINGS

Embodiments of the invention will now be described, by way of example, reference being made to the Figures of the accompanying diagrammatic drawings, in which.

DETAILED DESCRIPTION OF THE INVENTION

Figure 1:
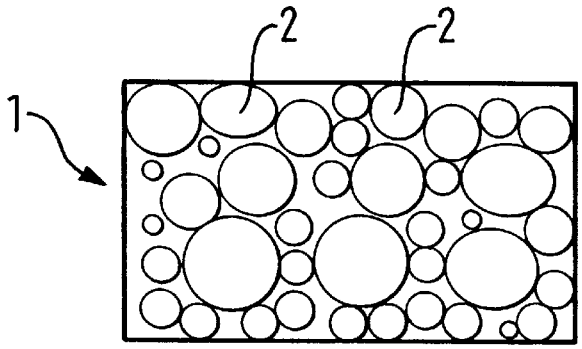
FIG. 1 is a cross-section through a gas container of the present invention.
Figure 2:
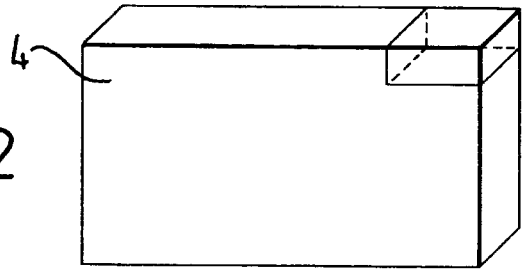
FIG. 2 is a perspective view of a gas container of the present invention in the form of a panel.

As shown in FIG. 1, a gas container 1 is made from metal foam in which the spaces defined by the open-celled structure are substantially filled with a solid gas adsorber material 2. The container may be of any desired shape and FIG. 2 illustrates a container in the form a flat panel 4.

Figure 3:
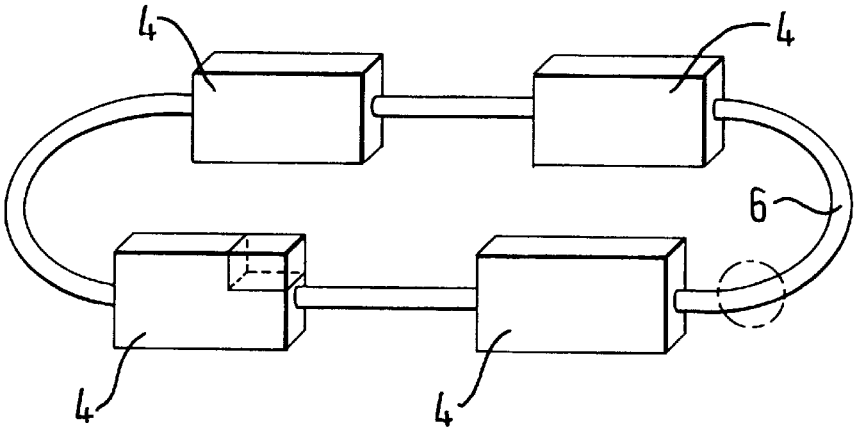
FIG. 3 illustrates a plurality of gas containers, similar to FIG. 2, arranged in series.
Figure 4:
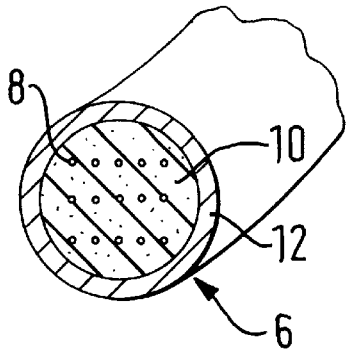
FIG. 4 is a cross-section through a connector interconnecting the gas containers shown in FIG. 3.

As shown in FIG. 3 a plurality of panels 4 are connected in series by means of connectors 6. Each connector 6 comprises a plurality of small-bore tubes 8 embedded in foamed rubber matrix 10 which is itself surrounded by a metallic protective sheath 12, all as shown in FIG. 4.

The container 1 is made by mixing the solid gas absorbing material, preferably a zeolite, activated carbon or silicate into molten aluminium. The solid gas absorbing material is manufactured in a variety of grain sizes depending on the density of "spacing" required and is stirred into the aluminium at the point of freezing (going solid). Alternatively, the molten aluminium could be poured over a matrix of the sized particles to form a block of adsorber/container. In this latter case, where the adsorber grains touch, would be gas paths in the gas container.

The advantages of such a container are as follows:

1) The container can be formed into any desired shape;
2) The container is robust and can contain a variety of gases;
3) The metallic component could be reduced, that is, compared with pure metal foam whilst still offering excellent strength characteristics; and
4) The container would be suitable for all gases such as oxygen, nitrogen, helium and argon and could be used for more hazardous products such as acetylene.

Finally, such gas containers could be designed into any shape, for example contoured to fit life-vests, panels in carrying cases, collars around other containers etc.

What is claimed is:

1. A gas container comprising two or more gas containers connected in series wherein said gas container comprises metal foam in which the spaces defined by the open-celled structure are substantially filled with a solid gas adsorber material and said two or more gas containers are connected by a connector comprising at least one small bore tube imbedded in a foamed rubber matrix encompassed by a protective metallic sheet.

* * * * *